US005663801A

United States Patent [19]

Hada et al.

[11] Patent Number: 5,663,801

[45] Date of Patent: Sep. 2, 1997

[54] CONTROL CIRCUIT FOR CONTROLLING STYLUS OVERSHOOT IN AN ENGRAVING MACHINE USED FOR ENGRAVING GRAVURE CYLINDERS AND METHOD FOR SAME

[75] Inventors: Kohji Hada; Tadashi Syudou, both of Kyoto, Japan

[73] Assignee: Dainippon Screen Mfg. Co., Ltd., Japan

[21] Appl. No.: 310,850

[22] Filed: Sep. 22, 1994

[30] Foreign Application Priority Data

Sep. 22, 1993 [JP] Japan ..... 5-236092

[51] Int. Cl.[6] ..... B41C 1/04

[52] U.S. Cl. ..... 358/299

[58] Field of Search ..... 358/299; 364/474.02, 364/474.04, 474.12, 474.35; 409/131, 204, 208; 83/358.361

[56] References Cited

U.S. PATENT DOCUMENTS

| | | | |
|---|---|---|---|
| 4,052,739 | 10/1977 | Wada et al. | 358/299 |
| 4,831,392 | 5/1989 | Dei | 358/298 X |
| 5,029,011 | 7/1991 | Fraser | 358/299 |
| 5,036,403 | 7/1991 | Hupka et al. | 358/299 |
| 5,172,132 | 12/1992 | Haneda et al. | 358/296 X |
| 5,416,597 | 5/1995 | Mubaslat | 358/299 |
| 5,438,422 | 8/1995 | Holowko et al. | 358/299 |

FOREIGN PATENT DOCUMENTS

| | | |
|---|---|---|
| 3724256 | 7/1987 | Germany . |
| 49-29045 | 3/1974 | Japan . |

OTHER PUBLICATIONS

German Journal, Helio–Klischograph K201 und K202 Programmierte Zylinderherstellung Fur den Tiefdruck. 1984 (with partial translation).

*Primary Examiner*—Eric Frahm

*Attorney, Agent, or Firm*—Ostrolenk, Faber, Gerb & Soffen, LLP

[57] ABSTRACT

An engraving machine for gravure printing to suppress the adverse effect upon the printed image by overshooting of the stylus. The gravure engraving machine has a stylus in an engraving head and controlled by an engraving signal in accordance with an image signal for engraving a surface in a gravure cylinder. An engraving signal generator is provided for generating a carrier signal to drive the stylus, and a modifying signal generator is provided for generating a modifying signal to modify overshoot waveforms caused when the engraving signal is applied to the engraving head. The gravure engraving machine also includes an adder for adding the modifying signal to the engraving signal to modify the engraving signal applied to the engraving head and thereby suppress overshooting of the stylus.

11 Claims, 9 Drawing Sheets

Reading Device (i.e. Scanner)
43
Image System
44
External Memory Device
45
Data Processor
42
Data Modifying Unit
51
Engraving Signal Generator
52
Modifying Signal Generator
53
Controller /Processor
56
Adder
54
Engraving Head
21
Motors
57

CONTROL CIRCUIT FOR CONTROLLING STYLUS OVERSHOOT IN AN ENGRAVING MACHINE USED FOR ENGRAVING GRAVURE CYLINDERS AND METHOD FOR SAME

BACKGROUND OF THE INVENTION

1. Field of the Invention

The present invention relates to an engraving machine for gravure printing, and more particularly, it relates to a gravure printing engraving machine in which a stylus mounted in an engraving head is controlled in accordance with a modified engraving signal to engrave the surface of a gravure cylinder.

2. Description of the Related Art

A gravure engraving machine is an apparatus in which a gravure cylinder having a copper plated surface, used in a gravure printing process, is selectively rotated and engraved so as to form numerous minute pyramid-shaped pits regularly arranged and referred to as "cells" in the surface of the cylinder. The amount of ink held in each cell and the number and orientation of a group of cells determines the size and appearance of subsequently printed matter. Therefore, the engraving of such cells in a gravure cylinder is extremely important. The size of each cell, in particular is of great importance because depth and width of each cell determines image density of the subsequently printed matter.

The engraving head on an engraving machine is used to form the cells in the surface of the cylinder. The engraving head includes a stylus having one end provided with a diamond bit. The stylus is vibrated at a variety of frequencies, generally in the kHz range, to perform the engraving.

The waveforms depicted in FIG. 8 represent portions of typical signals applied to the engraving head. The waveforms depicted are representative of the type waveforms necessary for displacement of the stylus. For instance, a complete engraving signal is typically obtained by superimposing a high-frequency carrier signal such as the waveform illustrated in FIG. 8(*a*) and a density signal (or image signal) such as the waveform illustrated in FIG. 8(*b*).

Applying the signal, an "engraving signal", formed by combining the waveforms in FIG. 8(*a*) and 8(*b*) to the engraving head, a cell corresponding in depth and width to the density signal can be engraved in the surface of the cylinder. A one-dot-dash line S in FIG. 8(*c*) corresponds with the surface of the cylinder while a region marked with hatched lines correspond to the cell to be engraved in the surface of the cylinder. The oscillating waveform in FIG. 8(*c*) corresponds to the combined "engraving signal" applied to the engraving head.

When the density signal mentioned above is applied to the engraving head, the displacement of the stylus becomes extraordinarily large in a position corresponding with a change in the density signal. Specifically, the displacement of the stylus overshoots its intended depth due to the change of the density signal, or rather at the point where the signal changes. FIG. 8(*d*) depicts the waveform sent to the engraving head with the displacement effected by the carrier signal omitted. A comparison of the combined signal depicted in FIG. 8(*c*) with the signal depicted in FIG. 8(*d*) shows that the desired displacement of the engraving head is not obtained.

Thus, when the engraving signal as shown in FIG. 8(*c*) is employed to drive the stylus, the displacement of the stylus assumes a waveform P as shown in FIG. 8(*e*) and causes a cell to be engraved with undesirable dimensions and position, and consequently this brings about degradation of quality in the resultant printing, including blur in an edge portion of an image.

In automatic gain control circuitry for example, a technology for suppressing overshoot in a signal is disclosed in Japanese Unexamined Patent Publication No. 29045/1974. However, this control circuit technology utilizes feedback of an output signal to suppress overshoot. However, such prior art technology employing feedback in a circuit cannot be applied to a mechanism of varying output, like the displacement of the stylus in the gravure printing engraving machine, since such output is very difficult to detect.

SUMMARY OF THE INVENTION

In one aspect of the present invention, an engraving machine for gravure printing includes an engraving signal generator, a modifying signal generator, a data modifying unit, and a stylus. The engraving signal generator generates an engraving signal in accordance with an image signal which represents the image to subsequently be printed. The modifying signal generator generates a modifying signal for modifying overshoot arising when the engraving signal is applied to an engraving head. The data modifying unit modifies the engraving signal based upon the modifying signal. The stylus is mounted on the engraving head and driven in accordance with the modified engraving signal to engrave surface of a gravure cylinder.

In such an arrangement, since a portion of the displacement of the stylus caused by overshoot is suppressed, engraving is performed in desired position in the gravure cylinder with high accuracy with less adverse effect upon a printed image.

Preferably, the gravure-printing engraving machine is arranged so that the modifying signal generator generates a modifying signal which suppresses any overshoots other than that of the first peak.

In this arrangement, the engraving signal is modified by the modifying signal suppressing any overshoots other than the first peak, and a cell is formed in accordance with the modified engraving signal. Since only the first peak of all the overshoots is kept in accordance with the modified signal, the cell in a boundary of an image region is formed farther inside in the image region. Thus, the boundary when printed is sharp.

It is an object of the present invention to suppress an adverse effect upon printed images because of overshoot of the stylus of an engraving machine for gravure printing.

It is another object of the present invention to produce a sharp edge of an image region in the gravure-printing engraving machine.

BRIEF DESCRIPTION OF THE DRAWINGS

These and other objects, features, aspects and advantages of the present invention will become more fully apparent from the following detailed description of the present invention when taken in conjunction with the accompanying drawings where like reference numerals denote corresponding parts throughout, in which.

DETAILED DESCRIPTION OF THE PREFERRED EMBODIMENT

Figure 1:
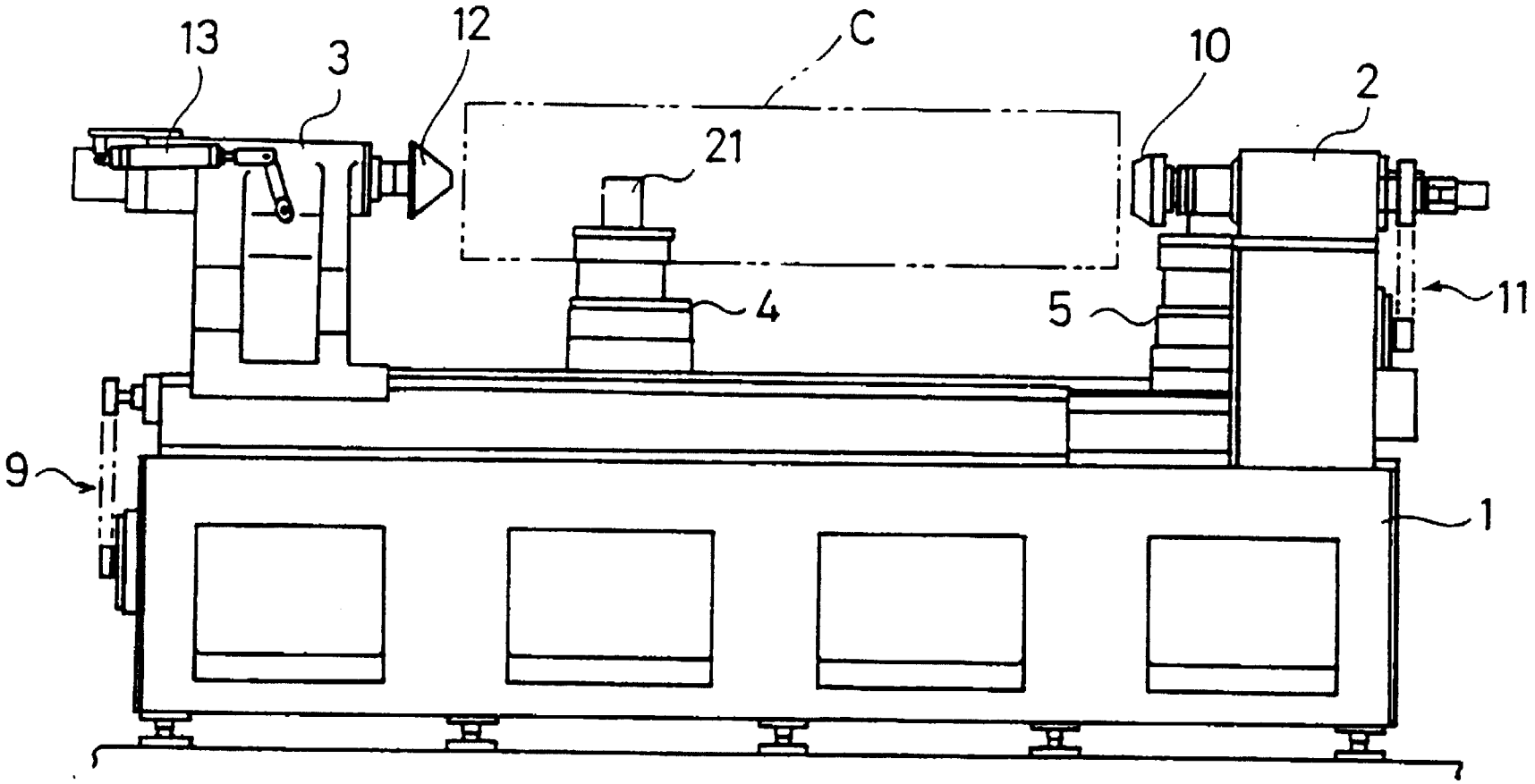
FIG. 1 is a front elevation showing an engraving machine for engraving gravure cylinders used in a gravure printing process according to one embodiment of the present invention.
Figure 2:
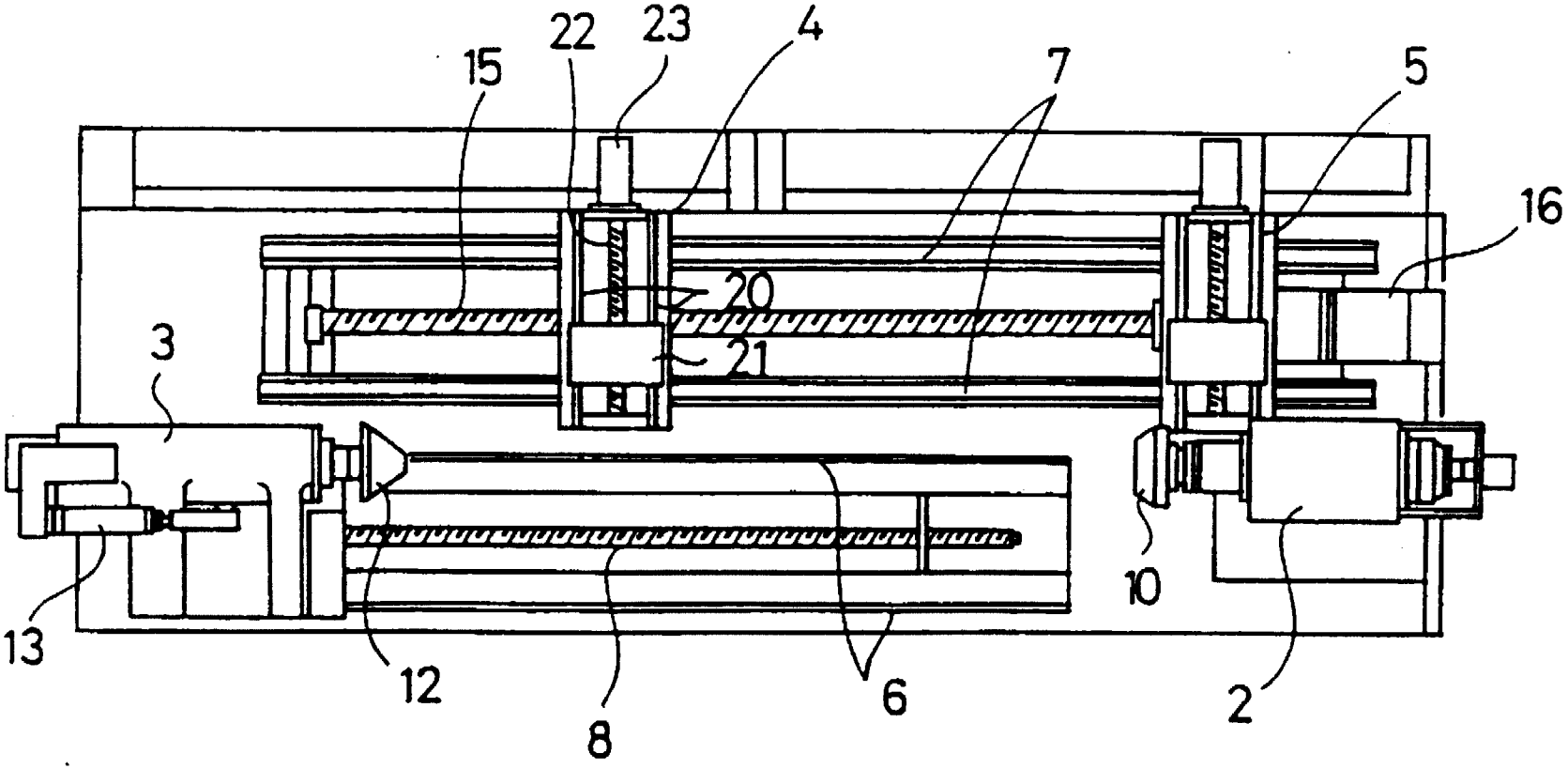
FIG. 2 is a top plan view of the engraving machine depicted in FIG. 1.

FIG. 1 and FIG. 2 depict an engraving machine for gravure printing according to a preferred embodiment of the present invention.

The gravure-printing engraving machine has a bed 1, a spindle stock 2 fixed to an upper surface of the bed 1, a tail stock 3 disposed opposite to the spindle stock 2, and a movable table 4. The tail stock 3 is slidable in lateral directions of the machine along a pair of guide rails 6 provided on the upper surface of the bed 1. A driving mechanism 9 including a motor and belt are attached to a side of the bed 1 and operate a drilling screw 8 while the tail stock 3 is moving close to or away from the spindle stock 2. A pneumatic cylinder 13 permits a quill 12 of the tail stock 3 to extend and retract in and out of position. In such an arrangement, a gravure cylinder C is supported between the spindle 10 and the quill 12 as shown by two-dot-dash line in FIG. 1.

The table 4 is slidable laterally along side of the cylinder C along a pair of guide rails 7 on the upper surface of the bed 1 by a rotation of a drilling screw 15 put in position between the rails 7. A motor 16 drives the drilling screw 15 to position the table 4. A spindle 10 on the spindle stock 2 is revolved by a driving mechanism 11 including a motor and a belt.

An engraving head 21 is attached to the table 4, movable in longitudinal directions through the machine. In the upper surface of the table 4, guide rails 20 are provided so that a driving mechanism comprised of a drilling screw 22 and a motor 23 allows the engraving head 21 to slide on the rails.

Figure 3:
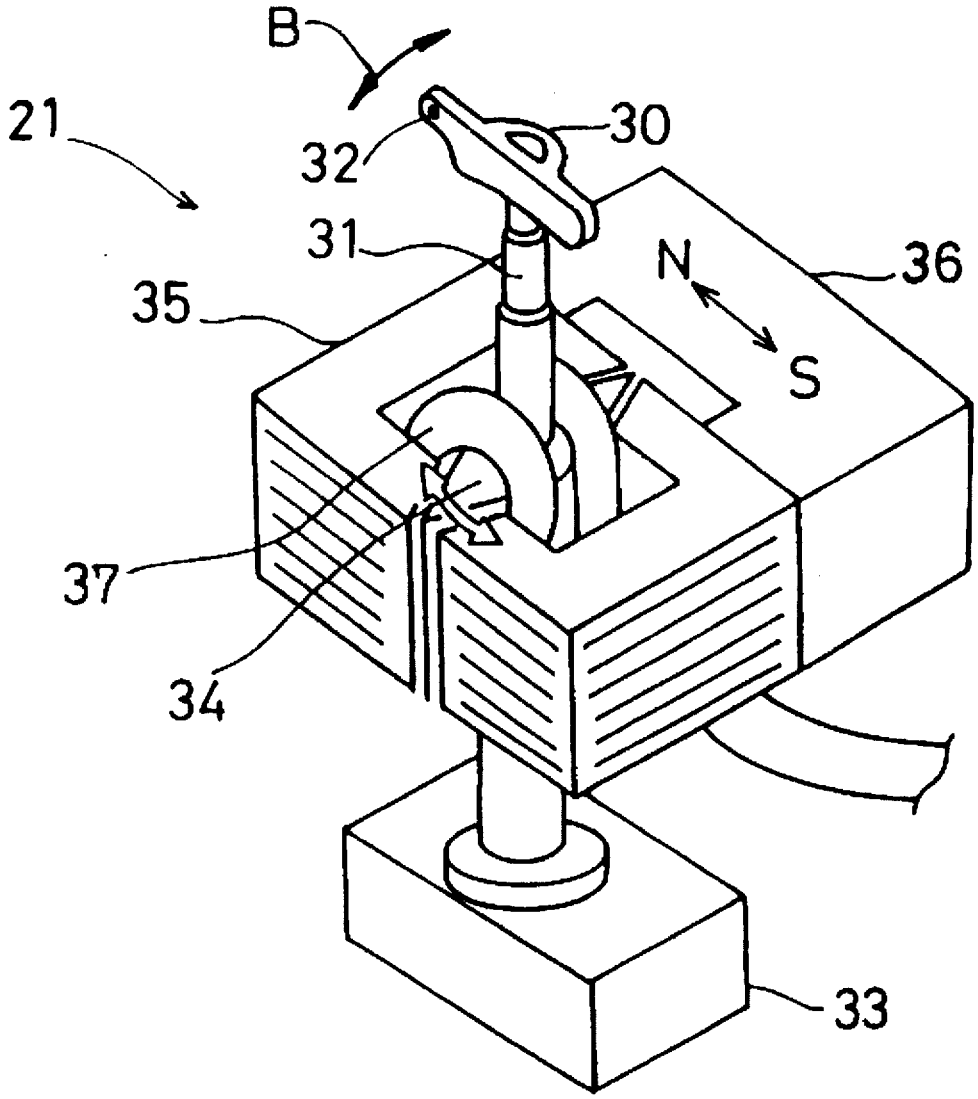
FIG. 3 is a perspective view showing an engraving head mounted to the engraving machine depicted in FIGS. 1 and 2.

FIG. 3 illustrates a stylus and a driving device in the engraving head 21.

The stylus 30 is fixed to a distal end of a twist shaft 31, having its one end attached to a diamond bite 32. A proximal end of the twist shaft 31 is fixed to a base 33. A rotor 34 having a flat rhombic top is fixed to an intermediate portion of the twist shaft 31. Surrounding the rotor 34, a pair of blocks of laminated magnetic substance ("stator" en bloc) 35 hold the rotor 34 between them, and a permanent magnet 36 for magnetizing the stator 35 is put on side contiguous to the stator 35. Moreover, encircling the rotor 34, a coil 37 is placed between the rotor 34 and the stator 35. In such an arrangement, applying an engraving signal to the coil 37 causes the stylus 30 to vibrate in accordance with a frequency of the engraving signal in a direction as illustrated by arrows.

Figure 4:
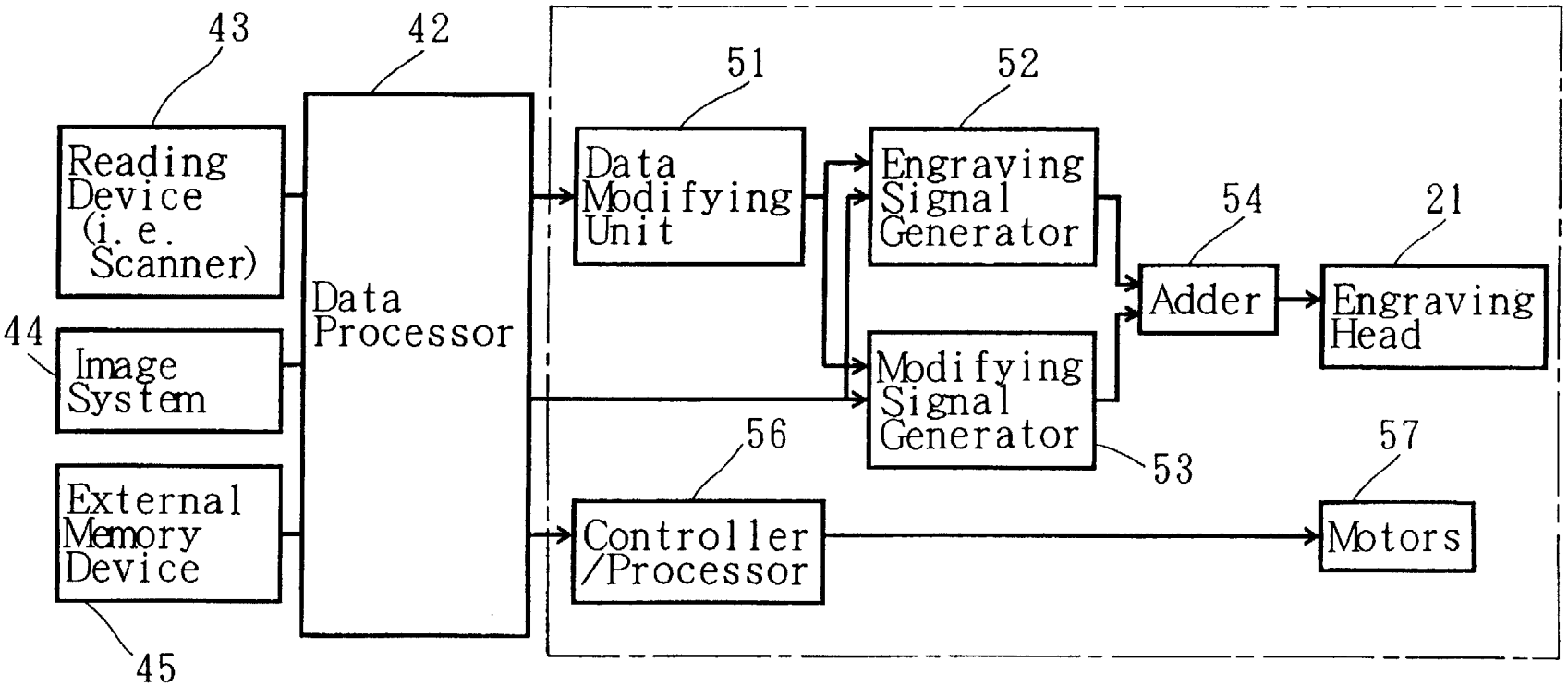
FIG. 4 is a block diagram illustrating the system architecture of portions of the circuitry which effect engraving by the engraving head depicted in FIG. 3.

FIG. 4 is a schematic block diagram showing the gravure printing engraving machine of the present invention.

The gravure-printing engraving machine is connected to a data processor 42. A reading device 43 such as a scanner, an image system 44 and an external memory device 45 are connected to the data processor 42. Thus, the data processor 42 receives an image signal from the devices 43 to 45.

The gravure-printing engraving machine receives image data and other signals from the data processor 42. The engraving machine has a data modifying unit 51 for modifying the image data received from the data processor 42 in conformity with distortion inherent in the machine, an engraving signal generator 52 for producing an engraving signal, a modifying signal generator 53 for generating a modifying signal to modify the engraving signal for the stylus, an adder 54 for adding the engraving signal and the modifying signal to modify the engraving signal to be applied to an engraving head 21, a controller/processor 56 for other function, and motors 57 for driving various moving members.

Figure 8:
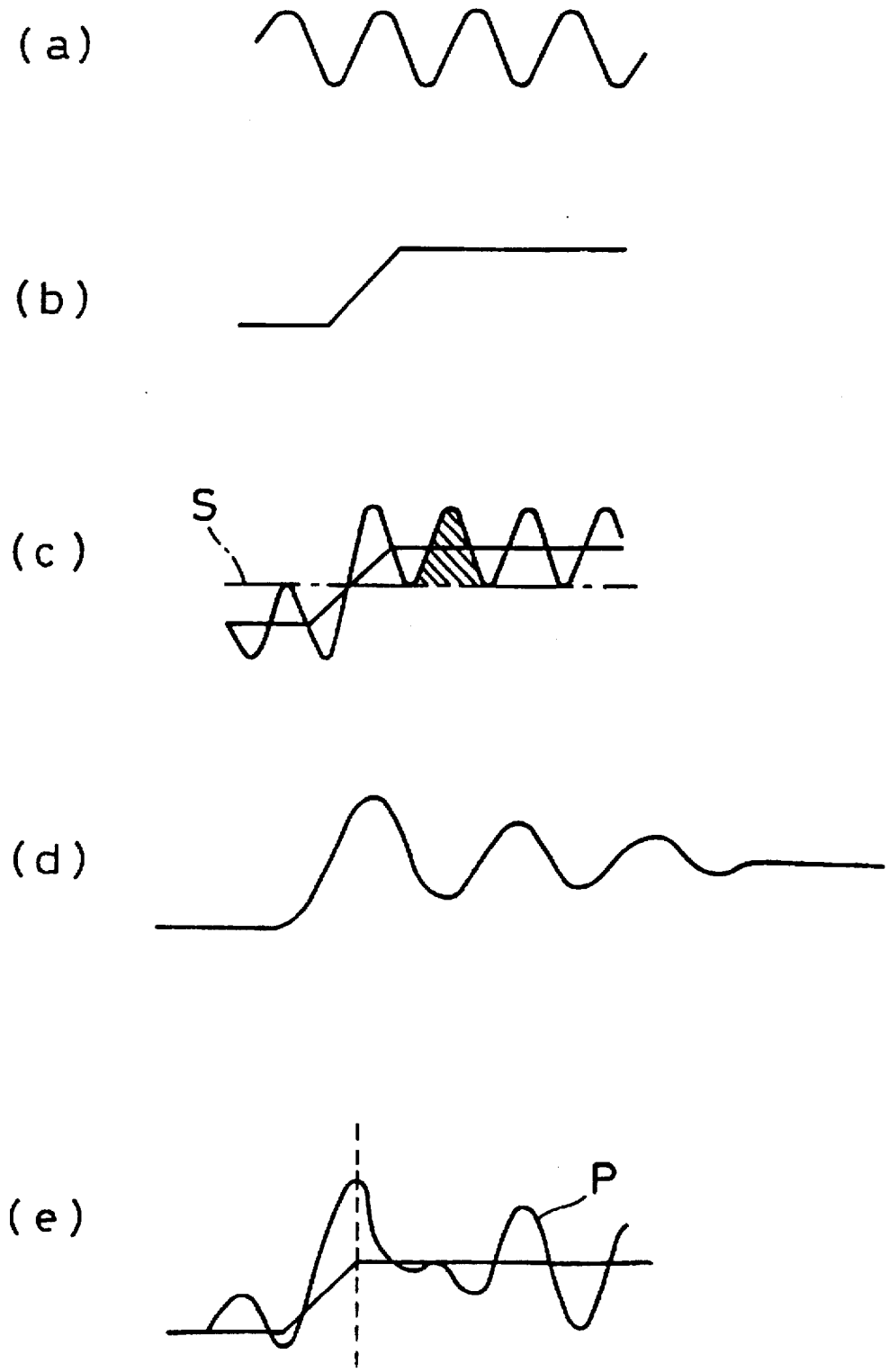
Fig.8 PRIOR ART
FIG. 8 is a waveform diagram representing various signals which illustrate the relationship between engraving signals and engraving head displacement.

The data modifying unit 51 is loaded with a modification table inherent in the machine based upon data obtained from preliminary engraving trial, and it modifies the image data in accordance with the modification table. Specifically, since some machines lack a linear characteristic, modification of the image data should be performed to correct such variation among machines. The engraving signal generator 52 further works as a carrier signal generator, which receives from the data processor 42 a timing signal for determining a timing of generation of a triangular wave signal (modifying signal) beside the image signal and produces a carrier signal approximated to sine wave based upon this signal. Also, in the engraving signal generator 52, the carrier signal and the modified image signal are combined into an engraving signal as shown in FIG. 8(*c*). The modifying signal generated by the modifying signal generator 53 is a signal shaped in triangular wave (see FIG. 5(*b*1)) to correct overshoot in displacement of the stylus which arises in applying the engraving signal to the engraving head, and output timing on the modifying signal is adjusted based upon the timing signal from the data processor 42 and then output to the adder 54. The controller/processor 56 receives control data from the data processor 42 to control the motors 57 driving the spindle, and other components.

Figure 6:
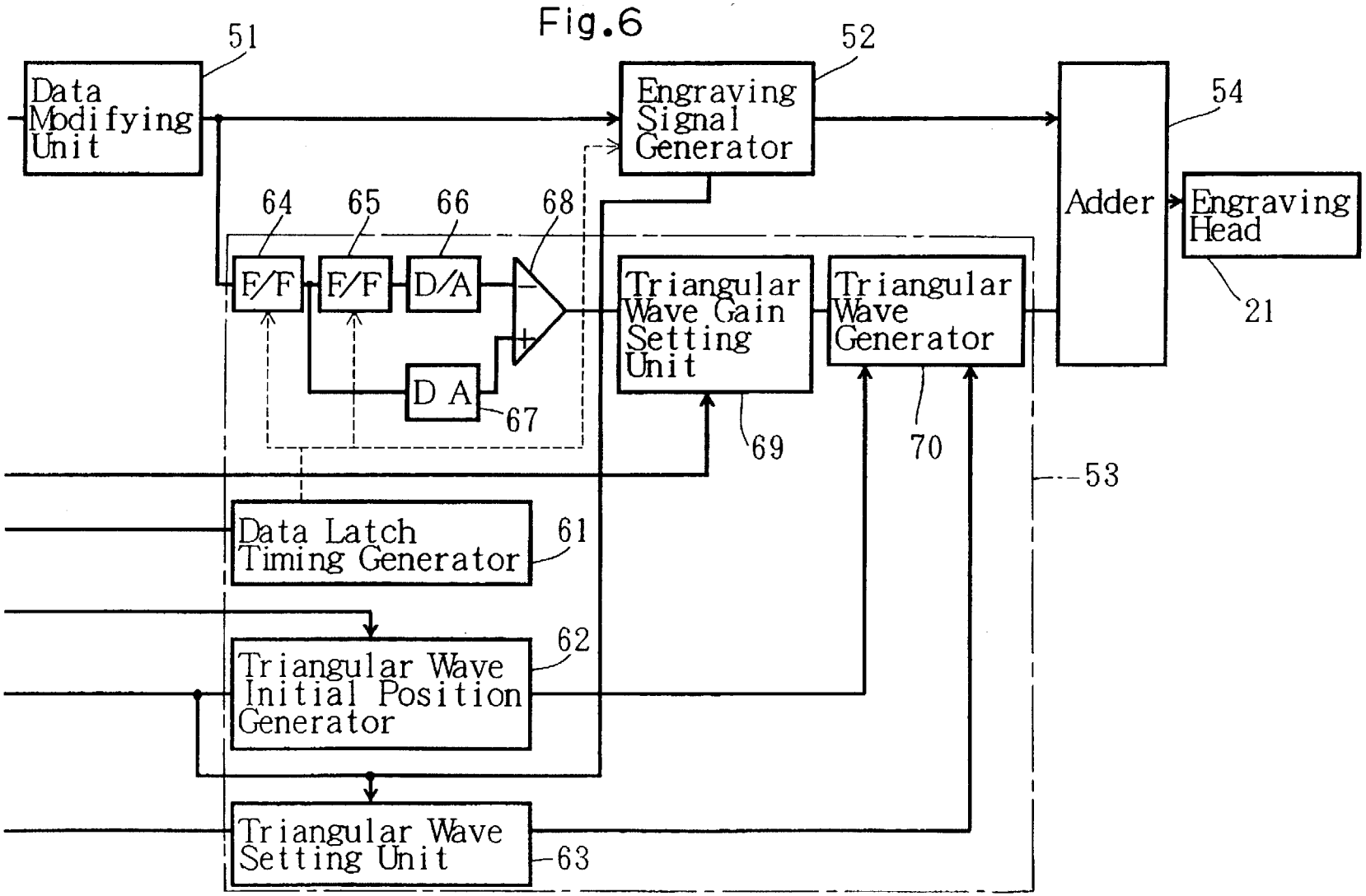
FIG. 6 is a block diagram depicting a modifying signal generator shown in FIG. 4.

FIG. 6 is a block diagram showing the modifying signal generator 53 in detail.

Figure 5:
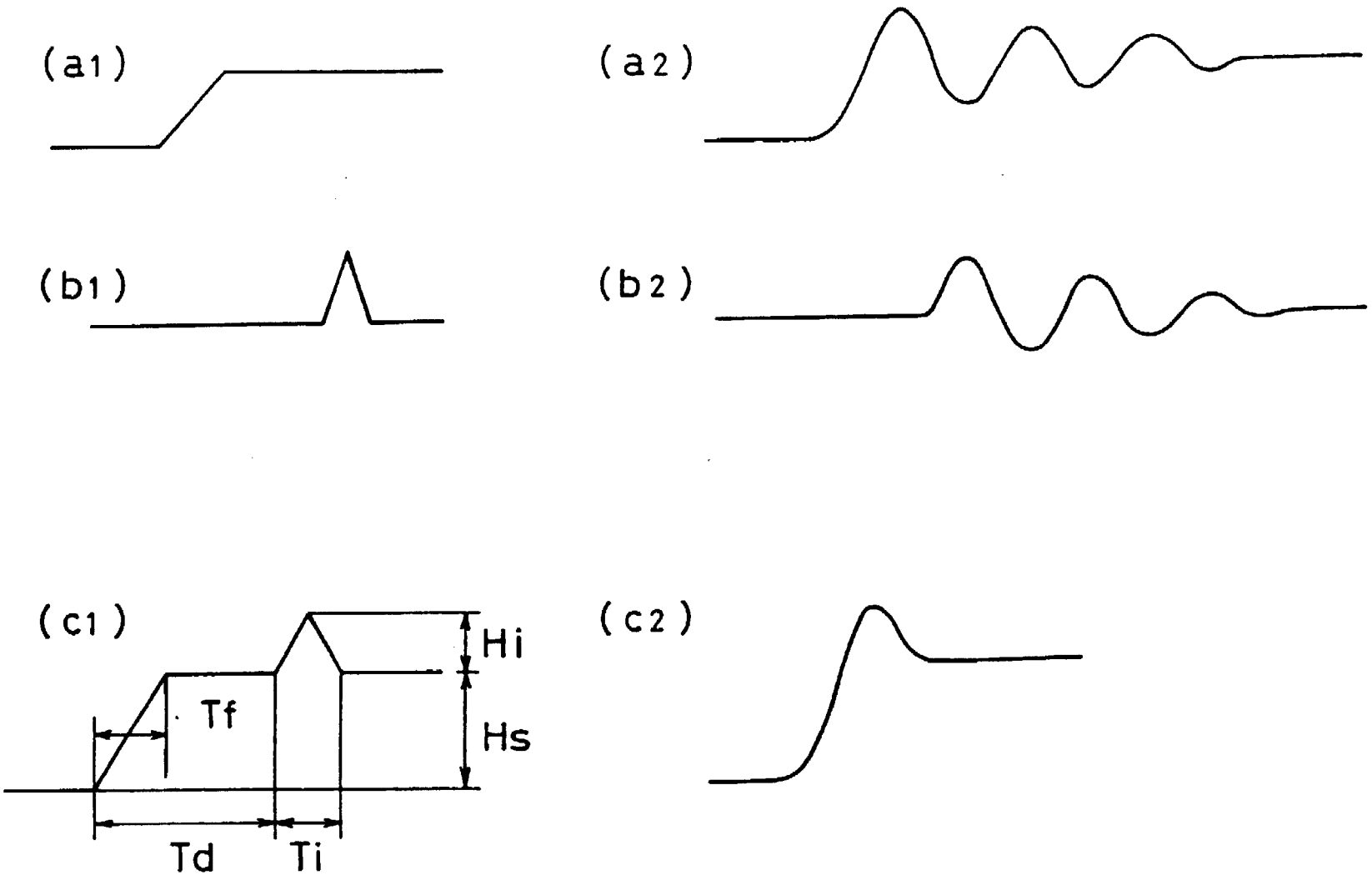
FIG. 5 is a waveform diagram showing an engraving signal, a modifying signal and displacement of a stylus on the engraving head, the signals generated in the circuitry depicted in FIG. 4 to control displacement of the engraving head stylus.

The modifying signal generator 53 has two succeeding stages of first and second flip flops, 64 and 65, receiving the image signal from the data modifying unit 51, a D/A converter 66 connected to the second flip flop 65 in the trailing stage, a D/A converter 67 connected to the first flip flop 64 in the leading stage, and a subtracter 68 receiving signals from both the D/A converters 66 and 67. The modifying signal generator 53 has a data latch timing generator 61 for generating a data latch signal, a triangular wave initial position genarator 62, a triangular wave width setting unit 63, a triangular wave gain setting unit 69, and a triangular wave generator 70. The data latch timing generator 61 receives a data latch cycle signal from the data processor 42 to generate a data latch signal based upon the data latch cycle signal. The triangular wave initial position generator 62 counts the above-mentioned timing signal based upon initial position data received from the data processor 42 to determine a value Td of an initial position of the triangular wave signal as shown in FIG. 5(*c*1). FIG. 5(*c*1) depicts a signal which is obtained by superimposing the triangular wave, functioning as a modifying signal, on the image signal. The triangular wave width setting unit 63 counts the timing signal based upon the triangular wave width control data received from the data processor 42 to determine a width Ti of the triangular wave signal. The triangular wave gain setting unit 69 sets a height of the triangular wave signal. The triangular wave generator 70 is loaded with a gain G set by the triangular wave gain setting unit 69, Td set by the triangular wave Initial position generator 62 and Ti set by the triangular wave width setting unit 63 to produce a triangular wave signal working as a modifying signal.

Figure 7:
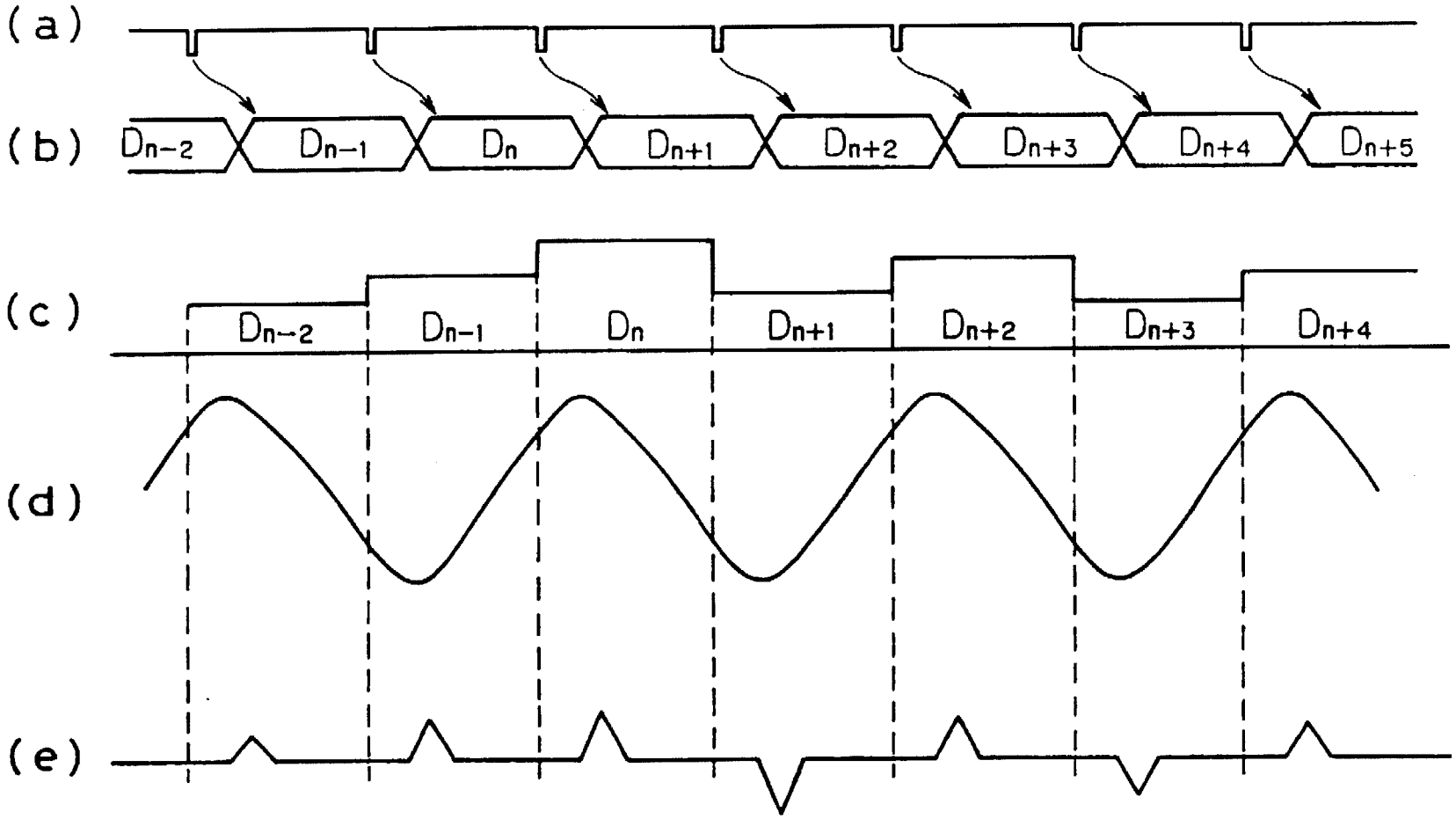
FIG. 7 is a timing chart depicting signals generated in one embodiment of the present invention.

An operation of this machine will now be described. FIG. 5 illustrates the Image signal, the triangular wave signal working as the modifying signal, a signal obtained by combining all of these signals, and their respective stylus waveforms. Although the carrier signal is omitted for the purpose of simplification in FIG. 5, the combined signal is, in practice, further superposed with the modifying signal after the carrier signal is superimposed on the image signal. Timing charts for those signals are shown in FIG. 7.

The data processor 42 receives data including the image signal from the reading device 43, the image system 44 or the external memory device. In the data processor 42, image data and other control signals are produced based upon the data applied thereto, and the resultant signals are transferred to the data modifying unit 51, the modifying signal generator 53, and the controller/processor 56 for other function.

The image data applied to the data modifying unit 51 is modified in accordance with the modification table. The motors 57 is controlled by the controller/processor 56 receiving the control signals. The image signal modified by the data modifying unit 51 is combined with the carrier signal by the engraving signal generator 52 and then applied to the adder 54.

Meanwhile, the modifying signal generator 53 produces a modifying signal for suppressing the second and following ones of all overshoots in the stylus displacement upon an application of the engraving signal to the engraving head. In case where the image signal assumes waveform as illustrated in FIG. 5(*a*1), the displacement of the stylus in the engraving head is expressed by a waveform as shown in FIG. 5(*a*2) where overshoot arises in the position equivalent to an edge of the image signal. Otherwise, in case where a triangular wave signal as shown in FIG. 5(*b*1) is applied to the engraving head, the displacement of the stylus assumes waveform with overshoot as shown in FIG. 5(*b*2). Thus, applying waveform as shown in FIG. 5(*c*1) which is obtained by superimposing FIG. 5(*a*1) and FIG. 5(*b*1), the displacement of the stylus is expressed as in a waveform shown in FIG. 5(*c*2) in which the second and following peaks in the waveform with overshoots are canceled.

Because of the reason as stated below, the second and following overshoots are suppressed while the first overshoot alone is kept.

Figure 9:
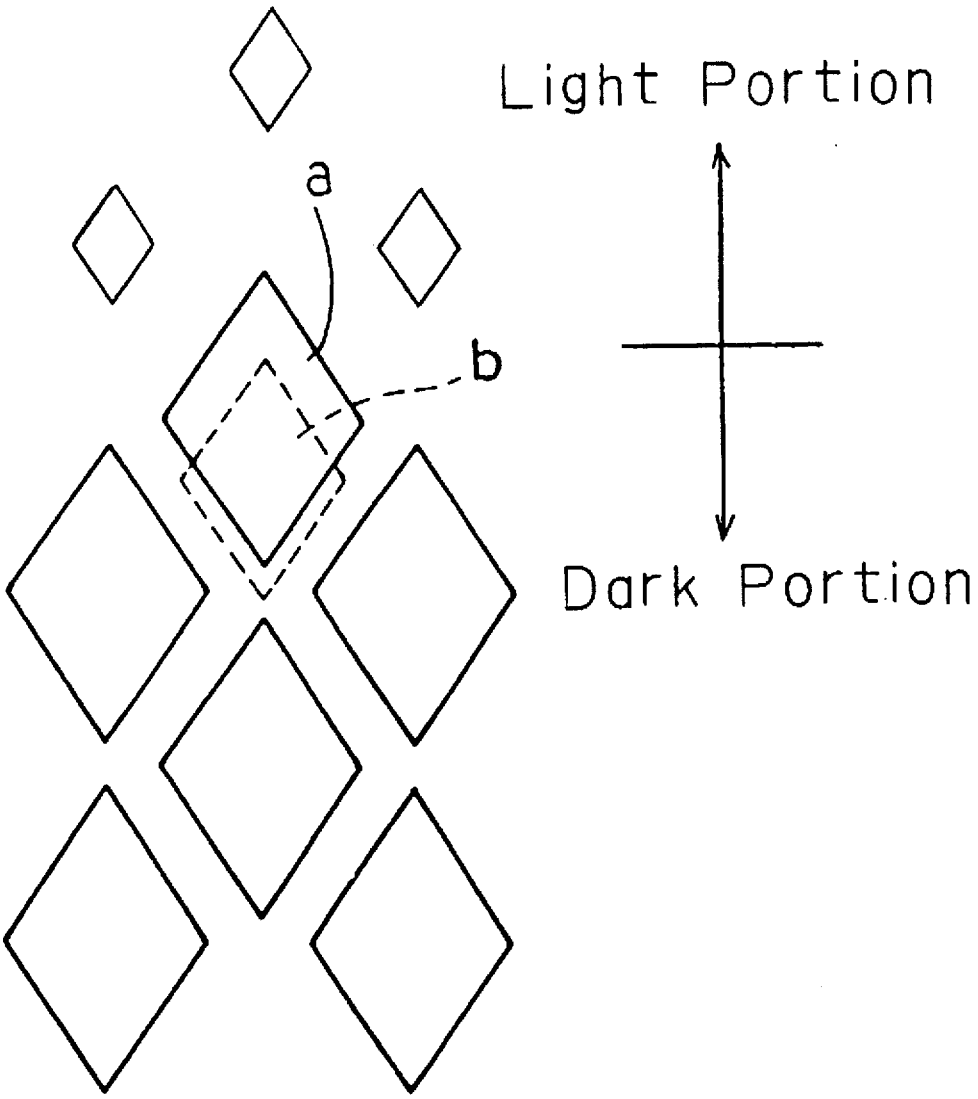
FIG. 9 is a diagram illustrating a cell or cells to be engraved on the surface of a gravure cylinder.

When no overshoot arises in the engraving head, a cell 'a' shown in FIG. 9 is engraved in the surface of a cylinder corresponding to an edge of an image. Once the overshoot arises, however, a position of a peak in the stylus displacement is deviated, and this leads to engraving a cell 'b' shown in FIG. 9. A comparison of the cell 'a' with the cell 'b' shown in FIG. 9, reveals that the cell 'b' is, for the most part, inside the image region, and this results in the boundary of the image being distinct. In other words, the first overshoot is useful in making the edge of the image sharper.

As to the modifying signal shaped in triangular wave and used for modifying the image data of FIG. 5(*a*1), its rising portion is delayed from the corresponding portion in the image data on the time basis so as to keep the first overshoot.

Referring to FIG. 5(*c*1), the modifying signal generator 53 determines a magnitude Hi of the modifying signal in proportion to a height of the image signal or a magnitude Hs of the density signal. Hence, the image signal modified by the data modifying unit 51 is applied to the first flip flop 64 and further to the second flip flop 65. Each of the flip flops 64 and 65 latches the image signal in accordance with a data latch signal from the data latch timing generator 61. Since output from the second flip flop 65 delays by a single cycle of the data latch signal from output from the first flip flop 64, data before rise of the image signal in FIG. 5(*a*1) is output from the second flip flop 65, and data after the rise is output from the first flip flop 64. In consequence, the subtracter 68 obtains the magnitude Hs of the density signal on its output. The triangular wave gain generator 69 multiplies the magnitude Hs of the density signal with a coefficient 'a' from the data processor 42 to produce the gain G corresponding to the magnitude Hi of the modifying signal.

As previously mentioned, it is needed causing timing delay (Td in FIG. 5(*c*1)) from the rise of the image signal till generation of the modifying signal in order to keep the first overshoot. Thus, the triangular wave initial position generator 62 counts the triangular wave generation timing signal based upon the initial position data received from the data processor 42 to determine a timing of generating the modifying signal. The triangular wave width setting unit 63 counts the timing signal based upon triangular wave width setting data received from the data processor 42 to determine the width Ti of the modifying signal.

The modifying signal determined as mentioned above is applied to the adder 54 and superposed on the engraving signal. Applying the resultant signal to the engraving head, the displacement of the stylus is expressed in the waveform as illustrated in FIG. 5(*c*2) where the first overshoot alone remains while the second and following overshoots are all canceled.

Details of various values in the signal waveform as illustrate in FIG. 5(*c*1) and examples about them will be discussed below.

Tf denotes a parameter (filter time) determining sharpness of the rise of the stylus in the image signal, and herein it is utilized to adjust a level of the first overshoot. As the overshoot becomes larger, the cell in the edge of the image deviates farther inside the image region, as mentioned above, and this results in the edge of the image being clarified. In the state of the art, the level of the first overshoot is 60 to 80% of a value required in adjustment in single dense engraving, and herein a fixed value is used. Tf is not a fixed value herein, but instead a tilt of the rise in the image signal may be fixed. Setting Tf to a fixed value, a period of time from application of the modifying signal till the peak of the overshoot is easily kept constant, and thus, adjustment of the level of the overshoot can be facilitated.

Preferably, the width Ti of the modifying signal is as short as possible. In this embodiment, it is set to a fixed value ranging from 40 μsec to 90 μsec.

The modifying signal generating timing Td is determined with a resonance frequency ωn of the engraving head and the filter time Tf. Specifically, Td=f (ωn, Tf) is satisfied, and it has been found that Td takes a value approximate to ½ cycle of ωn if input of the image signal is a step input and input of the modifying signal is an impulse input. Thus, in this embodiment, Td assumes a fixed value to each of individual engraving heads, varying from about 90 μsec to 250 μsec.

When the magnitude Hs of the density signal takes a minus value, the displacement of the stylus overshoots in a direction away from the gravure cylinder, and therefore, a signal shaped in triangular wave is used as the modifying signal when the Hs is of a minus quantity, as shown in FIG. 7(*e*1).

As has been described, in the gravure-printing engraving machine according to the present invention, overshoot caused when an engraving signal is applied to an engraving head is modified by a modifying signal, and hence, positional deviation of cells to be engraved and/or formation of undesirable cells can be avoided.

Furthermore, in the gravure-printing engraving machine in another aspect of the present invention, a modifying signal used for suppressing any overshoots other than that of the first peak of all modifies an engraving signal to form a cell farther inside an image region from the boundary of the image region, and therefore, the boarder between bright and dark in the image region can be clarified more definitely.

While the invention has been described and shown in detail, the foregoing description is in all aspects illustrative and not restrictive. It is therefore understood that numerous modifications and variations can be devised without departing from the scope of the invention.

What is claimed is:

1. An electronic circuit for controlling an engraving head on a gravure engraving machine, comprising:

a data processor for producing an image signal;

an engraving signal generating unit coupled to said data processor for generating an engraving signal in accordance with said image signal;

a modifying signal generating unit coupled to said data processor, said modifying signal generating unit having a wave generating unit for generating a wave signal which produces a single inverse wave to counteract overshoot caused when the engraving signal is applied to said engraving head; and an adder unit coupled to said generating units for combining said engraving signal and said single inverse wave and transmitting the combination to an engraving head.

2. An electronic circuit according to claim 1, wherein said modifying signal generating unit generates said modifying signal which subsequently combines with said engraving signal to suppress overshoots other than that of a first overshoot peak.

3. An electronic circuit according to claim 1 wherein said wave generating unit comprises a triangular wave generating unit for generating triangular wave signals.

4. An electronic circuit according to claim 1 wherein said wave generating unit comprises a triangular wave initial position generator, a triangular wave width setting unit and a triangular wave gain setting unit.

5. An electronic circuit according to claim 1, further comprising a data modifying unit connected between said data processor and said engraving signal generating unit configured to modify said engraving signal in accordance with a modification table loaded therein, said table corresponding to signal verses displacement responses from said corresponding engraving head.

6. An engraving machine comprising:

an engraving head selectively positionable adjacent to a gravure cylinder;

an engraving head control circuit having an engraving signal generating unit for generating an engraving signal and a modifying signal generating unit for generating a wave signal which produces a single inverse wave to counteract overshoot of the engraving head, wherein respective engraving signal and single inverse wave from said units are combined to form a modified engraving signal transmitted to said engraving head, said engraving head displaced by said modified engraving signal with at least a portion of overshoot of said engraving head being suppressed in the absence of a feedback circuit.

7. An engraving machine as set forth in claim 6 wherein said modified engraving signal displaces said engraving head with all but a first of overshoot signals being suppressed.

8. A method for controlling displacement of an engraving head comprising the steps of:

producing an image signal representing an image to be engraved by an engraving head:

generating an engraving signal in accordance with the image signal;

generating a wave signal which produces a single inverse wave to modify the engraving signal to reduce overshoot caused when the engraving signal is applied to an engraving head;

combining the engraving signal and the single inverse wave to produce a modified engraving signal; and transmitting the modified engraving signal to the engraving head such that at least a portion of stylus displacement overshoots are suppressed.

9. A electronic circuit for controlling an engraving head on a gravure engraving machine, comprising:

a data processor for producing an image signal;

an engraving signal generating unit coupled to said data processor for generating an engraving signal in accordance with said image signal;

a modifying signal generating unit coupled to said data processor for generating a modifying signal to modify said engraving signal to reduce overshoot caused when the engraving signal is applied to said engraving head;

an adder unit coupled to said generating units for combining said engraving signal and said modifying signal and transmitting the combined signal to an engraving head, and a data modifying unit connected between said data processor and said engraving signal generating unit configured to modify said engraving signal in accordance with a modification table loaded therein, said table corresponding to signal verses displacement responses from said corresponding engraving head.

10. An electronic circuit for controlling an engraving head on a gravure engraving machine, comprising:

a data processor for producing an image signal;

an engraving signal generating unit coupled to said data processor for generating an engraving signal in accordance with said image signal;

a modifying signal generating unit coupled to said data processor, said modifying signal generating unit having a wave generating unit for generating a wave signal which produces a single inverse wave to counteract overshoot caused when the engraving signal is applied to said engraving head;

an adder unit coupled to said generating units for combining said engraving signal and said single inverse wave and transmitting the combined signal to an engraving head, and a data modifying unit connected between said data processor and said engraving signal generating unit configured to modify said engraving signal in accordance with a modification table loaded therein, said table corresponding to signal verses displacement responses from said corresponding engraving head.

11. An electronic circuit for controlling an engraving head on a gravure engraving machine, comprising:

a data processor for producing an image signal;

an engraving signal generating unit coupled to said data processor for generating an engraving signal in accordance with said image signal, said engraving signal including a single change in image level;

a modifying signal generating unit coupled to said data processor for generating a single modifying signal to modify said engraving signal to reduce overshoot caused when the engraving signal including a single change in image signal level is applied to said engraving head;

an adder unit coupled to said generating units for combining said engraving signal including a single change in image signal level and said single modifying signal and transmitting the combined signal to an engraving head, and a data modifying unit connected between said data processor and said engraving signal generating unit configured to modify said engraving signal in accordance with a modification table loaded therein, said table corresponding to signal verses displacement responses from a corresponding engraving head.

* * * * *